US008743152B2

(12) United States Patent
Sakaigawa

(10) Patent No.: US 8,743,152 B2
(45) Date of Patent: Jun. 3, 2014

(54) DISPLAY APPARATUS, METHOD OF DRIVING DISPLAY APPARATUS, DRIVE-USE INTEGRATED CIRCUIT, DRIVING METHOD EMPLOYED BY DRIVE-USE INTEGRATED CIRCUIT, AND SIGNAL PROCESSING METHOD

(75) Inventor: Akira Sakaigawa, Kanagawa (JP)

(73) Assignee: Japan Display West, Inc., Aichi-Ken (JP)

( * ) Notice: Subject to any disclaimer, the term of this patent is extended or adjusted under 35 U.S.C. 154(b) by 403 days.

(21) Appl. No.: 12/457,451

(22) Filed: Jun. 11, 2009

(65) Prior Publication Data

US 2010/0007679 A1 Jan. 14, 2010

(30) Foreign Application Priority Data

Jul. 14, 2008 (JP) ..... 2008-183033

(51) Int. Cl.
*G09G 5/10* (2006.01)

(52) U.S. Cl.
USPC ..... 345/690; 345/88

(58) Field of Classification Search
USPC ..... 345/88, 690
See application file for complete search history.

(56) References Cited

U.S. PATENT DOCUMENTS

2004/0263528 A1* 12/2004 Murdoch et al. ..... 345/600
2007/0279372 A1* 12/2007 Brown Elliott et al. ..... 345/102

FOREIGN PATENT DOCUMENTS

| | | | |
|---|---|---|---|
| CN | 1813283 | A | 8/2006 |
| JP | 07-129113 | | 5/1995 |
| JP | 11-146209 | A | 5/1999 |
| JP | 2001-144975 | A | 5/2001 |
| JP | 2002-024268 | A | 1/2002 |
| JP | 2002-132225 | A | 5/2002 |
| JP | 2003-244458 | A | 8/2003 |
| JP | 2006-163069 | A | 6/2006 |
| JP | 2006-317899 | A | 11/2006 |
| JP | 2007-010753 | A | 1/2007 |
| JP | 2007-041595 | | 2/2007 |
| JP | 2007-212834 | A | 8/2007 |
| JP | 2008-026339 | A | 2/2008 |
| JP | 2008-107715 | A | 5/2008 |
| WO | WO-2007-004194 | A2 | 1/2007 |

OTHER PUBLICATIONS

Japanese Office Action issued May 26, 2011 for corresponding Japanese Application No. 2008-183033.
Japanese Office Action issued May 6, 2010 for corresponding Japanese Application No. 2008-183033.
Chinese Office Action issued Aug. 13, 2013 for corresponding Chinese Application No. 200910152273.7.

* cited by examiner

*Primary Examiner* — Chanh Nguyen
*Assistant Examiner* — Jonathan Blancha
(74) *Attorney, Agent, or Firm* — Rader, Fishman & Grauer PLLC

(57) ABSTRACT

Disclosed herein is a display apparatus including: a display pixel section including pixels each composed of an arrangement of red, green, and blue subpixels and an additional subpixel of a specified color; and a signal processing section configured to extend signal levels of an input image signal, extract a signal component of the specified color from extended red, green, and blue signals, determine a signal level of the specified color, perform an extension process based on the signal level of the specified color, modulate the red, green, and blue signals subjected to the extension process in accordance with a specified modulation level so as to have different brightness from that of an original image, and modulate brightness of a light source. The input image signal used to determine the modulation level and the input image signal subjected to a modulation process and displayed are of different frames.

13 Claims, 8 Drawing Sheets

DISPLAY APPARATUS, METHOD OF DRIVING DISPLAY APPARATUS, DRIVE-USE INTEGRATED CIRCUIT, DRIVING METHOD EMPLOYED BY DRIVE-USE INTEGRATED CIRCUIT, AND SIGNAL PROCESSING METHOD

BACKGROUND OF THE INVENTION

1. Field of the Invention

The present invention relates to a display apparatus and so on, for example. In particular, the present invention relates to technical fields for achieving a size reduction, a cost reduction, etc., of integrated circuits (ICs).

2. Description of the Related Art

In recent years, the functionality and versatility of display apparatuses have become greater, and accordingly, various techniques have been developed for optimizing brightness, contrast, etc., based on input image signals, in order to achieve proper image display. For example, Japanese Patent Laid-Open No. Hei 7-129113 (hereinafter referred to as Patent Document 1) discloses a technique of detecting the proportion of white brightness in the input image signals, and feeding a result of this detection back to a brightness adjustment circuit, in order to maintain steady brightness of a display screen despite changes in display content.

A so-called RGBW display, which uses red (R), green (G), blue (B), and white (W) subpixels, converts an input RGB image signal into an RGBW image signal to improve brightness and eventually reduce power consumption. For example, Japanese Patent Laid-Open No. 2007-41595 (hereinafter referred to as Patent Document 2) discloses a system in which the input RGB image signal is converted into the RGBW image signal, and this RGBW image signal is stored in a buffer section, and thereafter sent to a display apparatus for image display.

SUMMARY OF THE INVENTION

The technique disclosed in Patent Document 1, however, requires the input image signals to be stored in a frame memory. Similarly, the technique disclosed in Patent Document 2 requires the RGBW image signals obtained after the RGBW conversion to be stored in a frame memory. As such, in both techniques, an increase in the size and cost of an IC because of the frame memory is a problem.

The present invention addresses the above-identified, and other problems associated with related methods and apparatuses, and allows image signal processing to be performed without use of a frame memory to achieve a reduction in the size and cost of the IC, and facilitates achievement of high performance and low power consumption display.

According to a first embodiment of the present invention, there is provided a display apparatus including: a display pixel section including pixels each of which is composed of an arrangement of red, green, and blue output-use subpixels and an additional output-use subpixel of a specified color; and a signal processing section configured to extend signal levels of an input image signal, extract a signal component of the specified color from extended red, green, and blue signals, determine a signal level of the specified color, perform an extension process based on the determined signal level of the specified color, modulate the red, green, and blue signals subjected to the extension process in accordance with a specified modulation level so as to have different brightness from that of an original image, and at the same time modulate brightness of a light source. The input image signal used to determine the modulation level and the input image signal to be subjected to a modulation process and displayed by the display pixel section are of different frames.

Accordingly, in the signal processing section, an appropriate modulation process is performed on an input image signal in accordance with a modulation level determined based on a different input image signal.

According to a second embodiment of the present invention, there is provided a display apparatus including: a display pixel section including pixels each of which is composed of an arrangement of red, green, and blue output-use subpixels; and a signal processing section configured to modulate red, green, and blue input image signals in accordance with a specified modulation level so as to have different brightness from that of an original image, and at the same time modulate brightness of a light source. The input image signals used to determine the modulation level and the input image signals to be subjected to a modulation process and displayed by the display pixel section are of different frames.

Accordingly, in the signal processing section, an appropriate modulation process is performed on an input image signal in accordance with a modulation level determined based on a different input image signal.

According to a third embodiment of the present invention, there is provided a method of driving a display apparatus, the method including the steps of: a signal processing section modulating red, green, and blue input image signals in accordance with a specified modulation level so as to have different brightness from that of an original image, and at the same time modulating brightness of a light source; and a display pixel section presenting a display based on the modulated signals. The input image signals used to determine the modulation level and the input image signals to be subjected to a modulation process and displayed by the display pixel section are of different frames.

Accordingly, in the signal processing section, an appropriate modulation process is performed on an input image signal in accordance with a modulation level determined based on a different input image signal.

According to a fourth embodiment of the present invention, there is provided a drive-use integrated circuit including: a signal processing section configured to modulate red, green, and blue input image signals in accordance with a specified modulation level so as to have different brightness from that of an original image, and at the same time modulate brightness of a light source. The input image signals used to determine the modulation level and the input image signals to be subjected to a modulation process and displayed by a display pixel section are of different frames.

Accordingly, in the signal processing section installed on the drive-use integrated circuit, an appropriate modulation process is performed on an input image signal in accordance with a modulation level determined based on a different input image signal.

According to a fifth embodiment of the present invention, there is provided a driving method employed by a drive-use integrated circuit, the method including the steps of: a signal processing section modulating red, green, and blue input image signals in accordance with a specified modulation level so as to have different brightness from that of an original image, and at the same time modulating brightness of a light source; and presenting a display on a display pixel section based on the modulated signals. The input image signals used to determine the modulation level and the input image signals to be subjected to a modulation process and displayed by the display pixel section are of different frames.

Accordingly, according to this driving method, in the signal processing section installed on the drive-use integrated circuit, an appropriate modulation process is performed on an input image signal in accordance with a modulation level determined based on a different input image signal.

According to a sixth embodiment of the present invention, there is provided a signal processing method including the step of: modulating red, green, and blue input image signals in accordance with a specified modulation level so as to have different brightness from that of an original image, and at the same time modulating brightness of a light source. The input image signals used to determine the modulation level and the input image signals to be subjected to a modulation process and displayed are of different frames.

Accordingly, according to this method, an appropriate modulation process is performed on an input image signal in accordance with a modulation level determined based on a different input image signal.

The present invention provides a display apparatus, a method of driving a display apparatus, a drive-use integrated circuit, a driving method employed by a drive-use integrated circuit, and a signal processing method which allow image signal processing to be performed without use of a frame memory to achieve a reduction in size and cost of an IC, and facilitate achievement of high performance and low power consumption display.

DETAILED DESCRIPTION OF THE PREFERRED EMBODIMENTS

Hereinafter, preferred embodiments of the present invention will be described in detail with reference to the accompanying drawings.

A display apparatus according to an embodiment of the present invention includes: a display pixel section including pixels each of which is composed of an arrangement of red, green, and blue output-use subpixels; and a signal processing section configured to modulate red, green, and blue input image signals in accordance with a specified modulation level so as to have different brightness from that of an original image, and at the same time modulate brightness of a light source. The input image signals used to determine the modulation level and the input image signals to be subjected to a modulation process and displayed by the display pixel section are of different frames. The signal processing section determines the modulation level based on the input image signal of a previous frame, and uses a result of this determination to modulate the input image signal of a subsequent frame. The display apparatus may further include an information holding section configured to hold the modulation level determined based on the input image signal of the previous frame as image analysis information. An embodiment of the present invention is also applicable to an RGBW-type display apparatus. A detailed description will be provided below.

Figure 1:
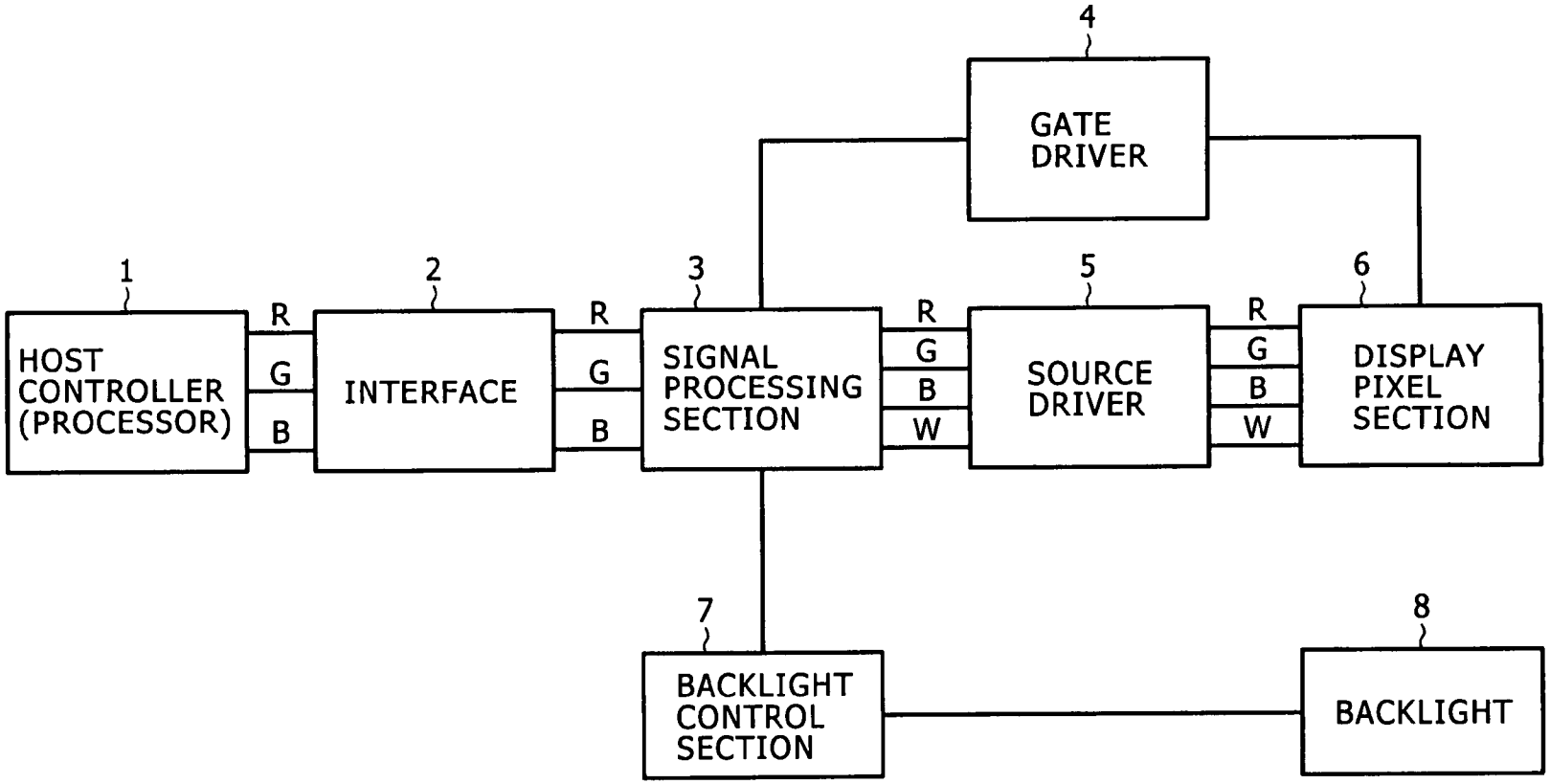
FIG. 1 illustrates the structure of an RGBW-type display apparatus according to an embodiment of the present invention.

FIG. 1 illustrates the structure of an RGBW-type display apparatus according to an embodiment of the present invention.

As illustrated in FIG. 1, the display apparatus includes a host controller (processor) 1 for control of the entire display apparatus, an interface 2, a signal processing section 3, a gate driver 4, a source driver 5, a display pixel section 6, a backlight control section 7, and a backlight 8.

In the display apparatus having the above structure, the host controller 1, which is, for example, an application processor, the interface 2, the signal processing section 3, and so on form part of an integrated circuit (IC). The host controller 1 sends an R (Red), G (Green), B (Blue) signal as an input image signal to the signal processing section 3 via the interface 2.

The RGB signal sent from the host controller 1 is converted into an RGBW signal by the signal processing section 3, and the resulting RGBW signal is outputted to various parts. At the same time, control signals, such as vertical and horizontal synchronization signals and a backlight control signal, are also outputted, and the display apparatus uses these control signals to display an RGBW image. That is, the signal processing section 3 supplies the control signals to the gate driver 4, the source driver 5, and the backlight control section 7.

Based on the control signals, the gate driver 4 performs on/off control on pixel transistors (thin film transistors (TFTs)) in the display pixel section 6. Based on the control signals supplied from the signal processing section 3, the source driver 5 holds RGBW digital image signals in a holding section thereof, and outputs them to the display pixel section 6 sequentially. Based on the control signals supplied from the signal processing section 3, the backlight control section 7 controls driving of the backlight 8.

The display pixel section 6 is formed, for example, by a liquid crystal display (LCD) in which m×n pixels are arranged in a matrix (where m, n=1, 2, . . . ). The display pixel section 6 is capable of displaying given information as an image, by causing transmittance of light emitted from the backlight 8 to vary in a liquid crystal layer under control of the backlight control section 7.

Each pixel as a unit of a display resolution is composed of four pixel components, i.e., R (Red), G (Green), B (Blue), and W (White) pixel components. Hereinafter, the pixel as the unit of the display resolution as composed of the R, G, and B pixel components and the W pixel component will be referred to as a "pixel," while each of the R, G, B, and W pixel components constituting the pixel will be referred to as a "subpixel." Red, green, and blue translucent color filters are arranged at positions corresponding to the R, G, and B subpixels, while a transparent filter is arranged at positions corresponding to the W subpixels.

Figure 2:
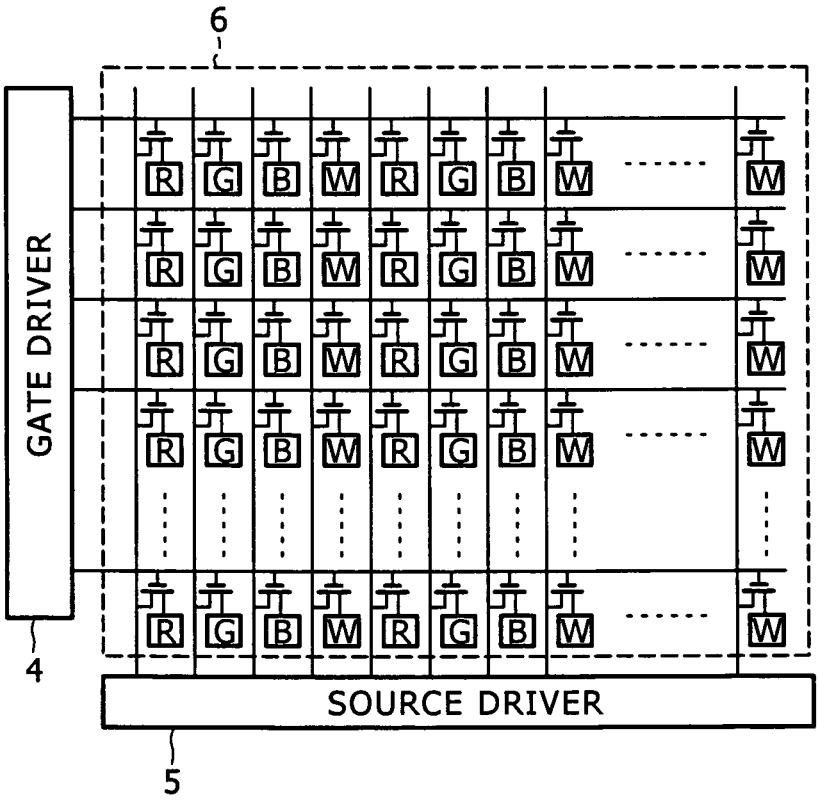
FIG. 2 illustrates an exemplary arrangement of pixels in a display apparatus.
Figure 3:
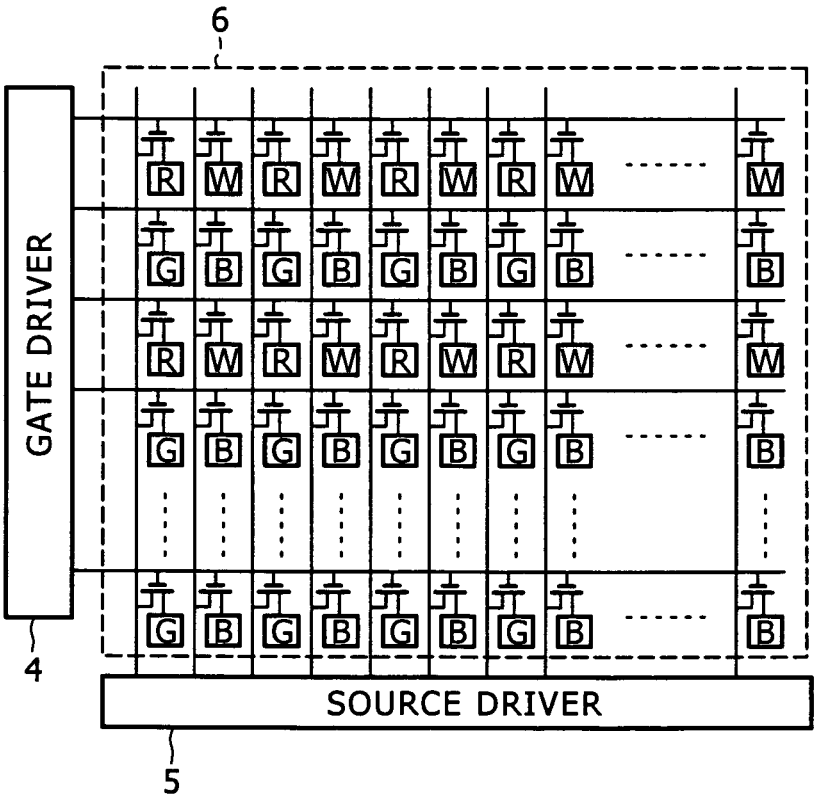
FIG. 3 illustrates another exemplary arrangement of pixels in a display apparatus.

FIGS. 2 and 3 illustrate exemplary arrangements of the pixels in the display apparatus.

FIG. 2 illustrates the pixels arranged in stripes (this arrangement will be hereinafter referred to as a "stripe arrangement"). FIG. 3 illustrates the pixels arranged in a mosaic pattern (this arrangement will be hereinafter referred to as a "mosaic arrangement"). In the stripe arrangement, the R, G, B, and W subpixels are arranged sequentially in each row, and subpixels of each color are arranged at the same horizontal positions in each row.

On the other hand, in the mosaic arrangement, the R and W subpixels are arranged sequentially in an Nth row, while the G and B subpixels are arranged sequentially in an (N+1)th row. In other words, in the mosaic arrangement, each pixel is composed of the R and W subpixels in the Nth row and the G and B subpixels in the (N+1)th row.

In general, the stripe arrangement is suitable for displaying data or character strings on a personal computer and the like, whereas the mosaic arrangement is suitable for displaying natural pictures on a camcorder, a digital still camera, and the like.

Next, details of the signal processing section 3 will now be described below.

In order to facilitate understanding of the signal processing section 3 adopted in the present embodiment, the structure of a common signal processing section 10 and a flow of signal processing therein will be first described briefly below.

Figure 4:
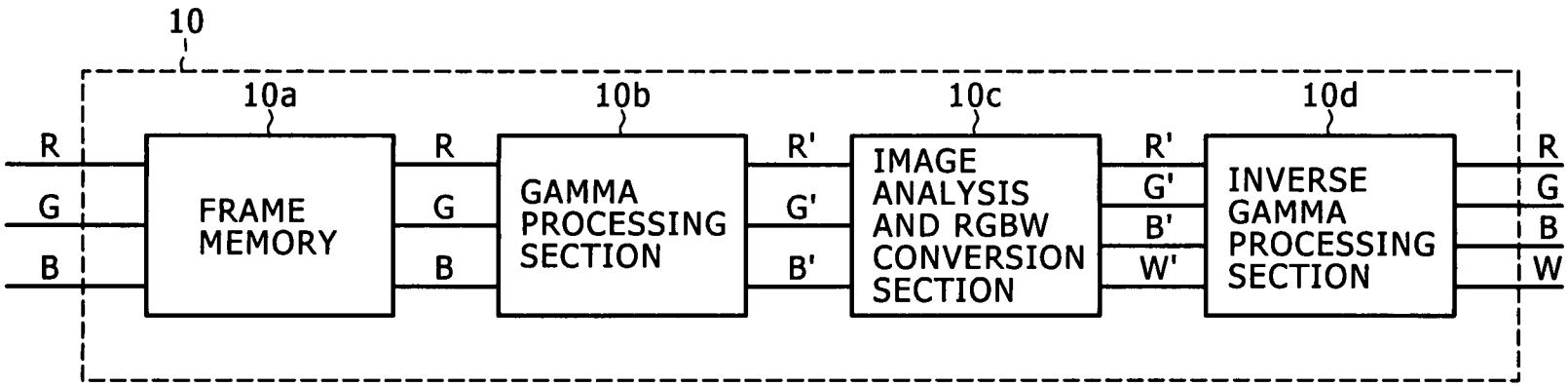
FIG. 4 illustrates the structure of a common signal processing section.

FIG. 4 is a block diagram illustrating the structure of the common signal processing section 10.

As illustrated in FIG. 4, the signal processing section 10 includes a frame memory 10*a*, a gamma processing section 10*b*, an image analysis and RGBW conversion section (hereinafter referred to as an "image analysis section" for short) 10*c*, and an inverse gamma processing section 10*d*.

In the signal processing section 10 having the above structure, an RGB image signal sent via the interface 2 is stored in the frame memory 10*a* temporarily. The image information stored in the frame memory 10*a* is sent to the gamma processing section 10*b*, a computation is performed therein so that a gradation-brightness characteristic will have a linear relationship, and a corresponding R'G'B' signal is outputted therefrom. Next, the image analysis section 10*c* analyzes the image information to extract information necessary for RGBW conversion, uses this information to convert each R'G'B' signal into an R"G"B"W" signal sequentially, and outputs the R"G"B"W" signals. The R"G"B"W" signals are subjected in the inverse gamma processing section 10*d* to a computation process so as to have an inverse gamma characteristic, and sent as RGBW signals to the display pixel section 6.

Figure 5:
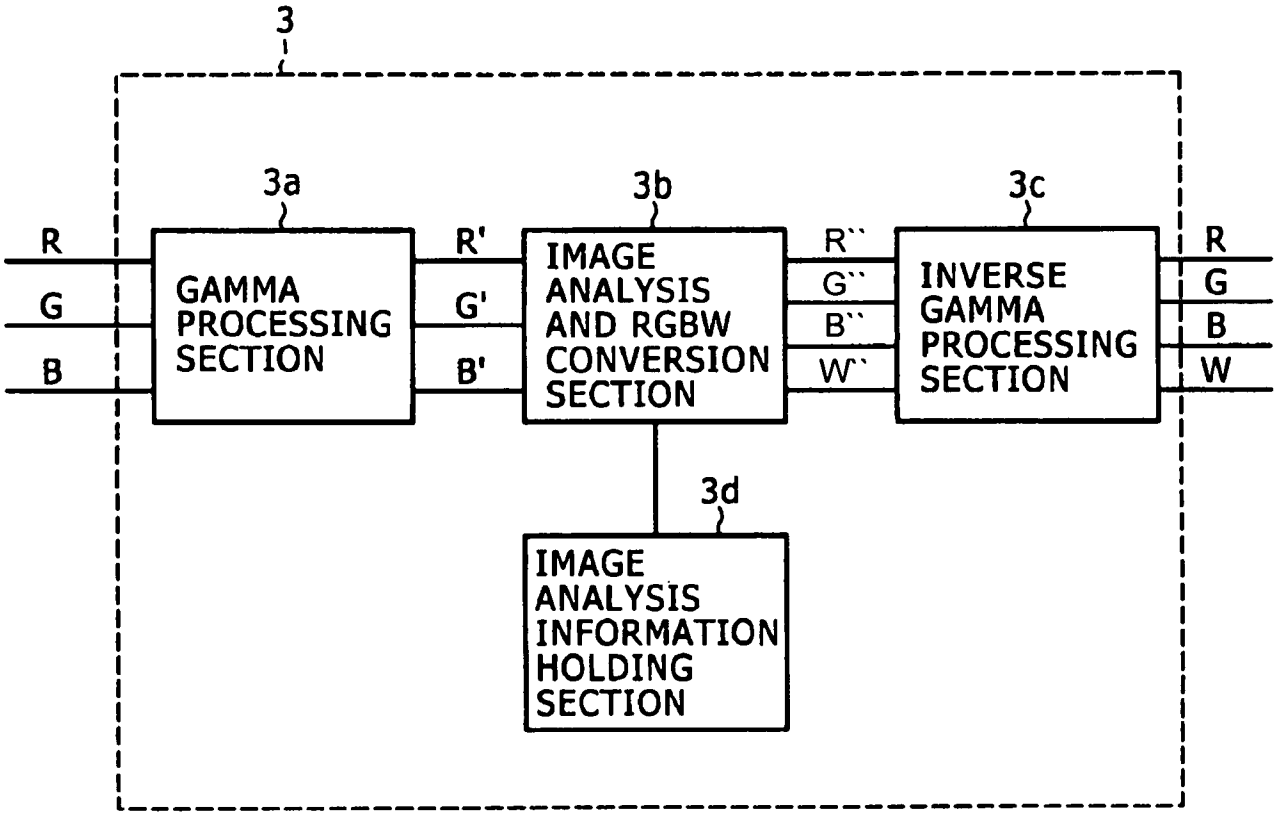
FIG. 5 illustrating the structure of a signal processing section adopted in an embodiment of the present invention.

In contrast, the structure of the signal processing section 3 adopted in the display apparatus according to an embodiment of the present invention is as illustrated in FIG. 5.

As illustrated in FIG. 5, the signal processing section 3 includes a gamma processing section 3*a*, an image analysis and RGBW conversion section (hereinafter referred to as an "image analysis section" for short) 3*b*, an inverse gamma processing section 3*c*, and an image analysis information holding section 3*d*.

In the signal processing section 3 having the above structure, the RGB image signal sent via the interface 2 is sent to the gamma processing section 3*a* without passing through a frame memory. In the gamma processing section 3*a*, a computation is performed so that the gradation-brightness characteristic will have a linear relationship, and a corresponding R'G'B' signal is outputted. Then, in the image analysis section 3*b*, the R'G'B' signal is analyzed to extract the information necessary for the RGBW conversion, and this information is stored in the image analysis information holding section 3*d*. Therefore, as a result of the analysis of the incoming R'G'B' signals, the information necessary for the RGBW conversion is constantly held in the image analysis information holding section 3*d*.

Notice here that the signal processing section 3, without the frame memory, is incapable of the traditional RGBW conversion because of a delay that occurs when the R'G'B' signal sent from the gamma processing section 3*a* is analyzed in real time to perform the RGBW conversion based on the R'G'B' signal.

However, image analysis information about a previous frame is held in the image analysis information holding section 3*d*, and the RGBW conversion can be performed based on this image analysis information. Therefore, the signal processing section 3 is capable of converting the incoming RGB signal into the RGBW signal in real time, without storing the RGB signal in a frame memory. The converted RGBW signal (i.e., the R"G"B"W" signal) is sent to the inverse gamma processing section 3*c*. In the inverse gamma processing section 3*c*, the R"G"B"W" signal is subjected to a computation process so as to have the inverse gamma characteristic again, and sent as the RGBW signal to the display pixel section 6.

Note that the analysis and conversion processes described above correspond to the modulation process.

As described above, in the signal processing section 3, the RGB signal is modulated in accordance with a specified modulation level so as to have different brightness from that of an original image, and brightness of a light source is modulated at the same time. At this time, the RGB signal used to determine the modulation level and the input image signal subjected to the modulation process and displayed by the display pixel section 6 are of different frames. The signal processing section 3 determines the modulation level based on the RGB signal of the previous frame, and uses the result of this determination to modulate the RGB signal of the subsequent frame. The determination of the modulation level may be performed for the RGB signal of each frame.

In the case where the above-described arrangement is adopted, the conversion of the RGB signal into the RGBW signal may not sometimes be accomplished properly when image information of the previous frame differs greatly from current image information. However, in the case of a display apparatus with a frame frequency of 60 Hz, for example, the image analysis information is updated every 16.7 msec, but it is inconceivable that images actually displayed change greatly every 16.7 msec. In general, in the case of images in television (TV) or movies, for example, a change of the image information between successive frames is small, and the change of the image information is smooth. Moreover, in the case of still images, the image information hardly changes, and the same information continues to be displayed over multiple frames.

Therefore, no problem arises even if the conversion of the RGB signal into the RGBW signal is performed using the image analysis information of the previous frame as in the present embodiment. The image information may sometimes change greatly for an instant, but it would be an incident lasting for 16.7 msec, and if the next instance of the RGBW conversion performed 16.7 msec later does not involve a problem, no human eye would be able to recognize a problem. Moreover, in recent years, there has been a trend toward increased frame frequencies of image display apparatuses, with the view of improving display quality of video images. For example, many televisions using a liquid crystal display perform display at approximately 120 Hz. In this case, the change in the information between successive frames is still smaller, and the conversion method using the information of the previous frame is effective.

Next, basic principles of the signal processing for the RGBW conversion will now be described below.

In the case where the image signal inputted to the display pixel section (panel) 6 is an RGB digital signal, and each color is expressed by 8 bits, for example, signal levels of red, green, and blue, denoted as Ri, Gi, and Bi, respectively, are expressed by an integer value between 0 and 255.

Suppose that signals of red, green, blue, and white for RGBW display are denoted as Ro, Go, Bo, and Wo, respectively. Then, the following relationship must be satisfied, in order to maintain image quality of displayed video.

$$Ri:Gi:Bi=Ro+Wo:Go+Wo:Bo+Wo$$

Assume that the maximum of the Ri, Gi, and Bi signals are denoted as Max(Ri, Gi, Bi). Then the following relationships are satisfied.

$$Ri/\mathrm{Max}(Ri, Gi, Bi)=(Ro+Wo)/(\mathrm{Max}(Ri, Gi, Bi)+Wo)$$

$$Gi/\mathrm{Max}(Ri, Gi, Bi)=(Go+Wo)/(\mathrm{Max}(Ri, Gi, Bi)+Wo)$$

$$Bi/\mathrm{Max}(Ri, Gi, Bi)=(Bo+Wo)/(\mathrm{Max}(Ri, Gi, Bi)+Wo)$$

Therefore, the following relationships are satisfied.

$$Ro=Ri\times((\mathrm{Max}(Ri, Gi, Bi)+Wo)/\mathrm{Max}(Ri, Gi, Bi)Wo$$

$$Go=Gi\times((\mathrm{Max}(Ri, Gi, Bi)+Wo)/\mathrm{Max}(Ri, Gi, Bi)Wo$$

$$Bo=Bi\times((\mathrm{Max}(Ri, Gi, Bi)+Wo)/\mathrm{Max}(Ri, Gi, Bi)Wo$$

At this time, assuming that the minimum of the Ri, Gi, and Bi signals is denoted as Min(Ri, Gi, Bi), the signal Wo that can be applied is defined as follows.

$$Wo=f(\mathrm{Min}(Ri, Gi, Bi)$$

The simplest form of this relationship is as follows.

$$Wo=\mathrm{Min}(Ri, Gi, Bi)$$

In the case where a traditional method is adopted, however, Wo=0 for any image signal where Min(Ri, Gi, Bi)=0, and the brightness is not improved, and therefore a reduction in power consumption cannot be achieved.

Moreover, in the case where the value of Min(Ri, Gi, Bi) is small, the value of Wo is also small, and an effect of improved brightness is limited. That is, an effect of reduced power consumption is limited.

Furthermore, since the above-described process is performed with respect to all pixels in a given image, it may so happen that a part of the image is extremely bright while another part of the image is not made brighter.

More specifically, in the case where there is data of a color with high saturation, e.g., monochromatic data, within a bright background with low saturation, for example, signals for the background can have large values of Wo to increase the brightness, but the monochromatic data cannot have a non-zero value of Wo, resulting in a failure to increase the brightness.

In general, human sensibility for colors and brightness (i.e., visual characteristics) is greatly affected by differences in brightness relative to surroundings, and therefore, the monochromatic data, which has relatively low brightness, sometimes appears very dark. This is called simultaneous contrast, which has posed a significant problem in related-art RGBW display apparatuses.

In order to solve the problem as described above, the following process is performed in the display apparatus and signal processing method according to the present embodiment. This process is performed by the signal processing section 3 of the display apparatus as illustrated in FIG. 1.

First, an extension process performed on the input image signals will now be described below.

The input image signals Ri, Gi, and Bi are extended such that a ratio therebetween is maintained.

$$Ri'=\alpha\times Ri$$

$$Gi'=\alpha\times Gi$$

$$Bi'=\alpha\times Bi$$

where $\alpha$ is a natural number.

In order to maintain the image quality of the image signals, it is desirable that the extension process be performed such that the ratio (i.e., brightness ratio) between R, G, and B is maintained. It is also desirable that the extension process be performed such that the gradation-brightness characteristic (gamma) of the input image signals Ri, Gi, and Bi is maintained. In this regard, the above extension process has a limitation in the case of known RGB display apparatuses, since the maximum value is 255 in the case of the 8-bit digital signal. In particular, in the case of high-brightness image signals, the image signals can sometimes hardly be extended.

In contrast, the display apparatus according to the present embodiment is of the RGBW type, and the addition of the W subpixels increases a dynamic range of the brightness, resulting in an expanded color space for displaying. The extension process is performed up to an upper limit of an RGBW color space. Therefore, the maximum value, 255, in the case of the known RGB display apparatuses can be exceeded by the above extension process.

In the case where the brightness of the W subpixel is K times the brightness of the RGB subpixels, for example, the maximum value of Wo can be considered as 255×K, and the values of Ri', Gi', and Bi' can be extended up to (1+K)×255 in the RGBW color space. Therefore, the improvement in the brightness can be achieved even for data for which Min(Ri, Gi, Bi)=0 or which has small values, and the effect of reduced power consumption can be achieved.

Figure 6:
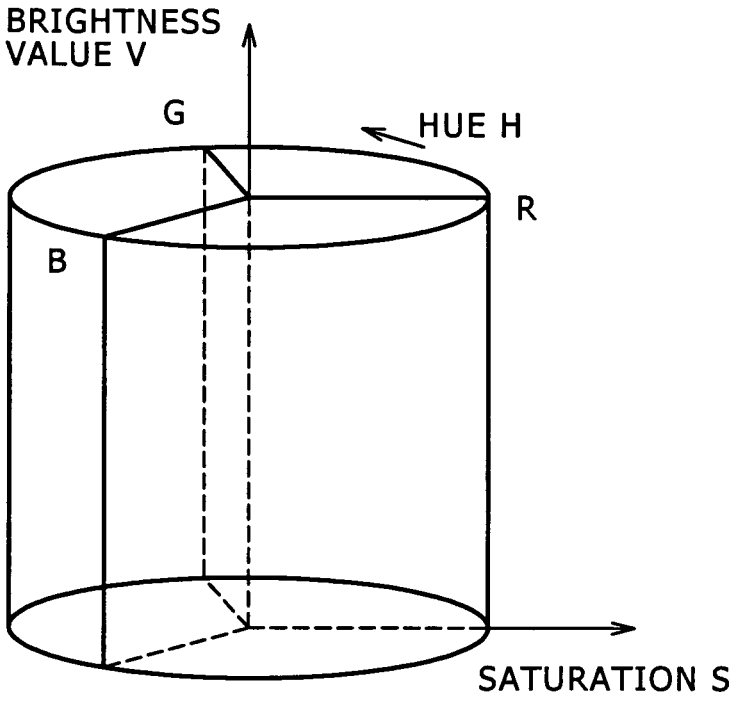
FIG. 6 illustrates a color space for an RGB-type display apparatus.
Figure 7:
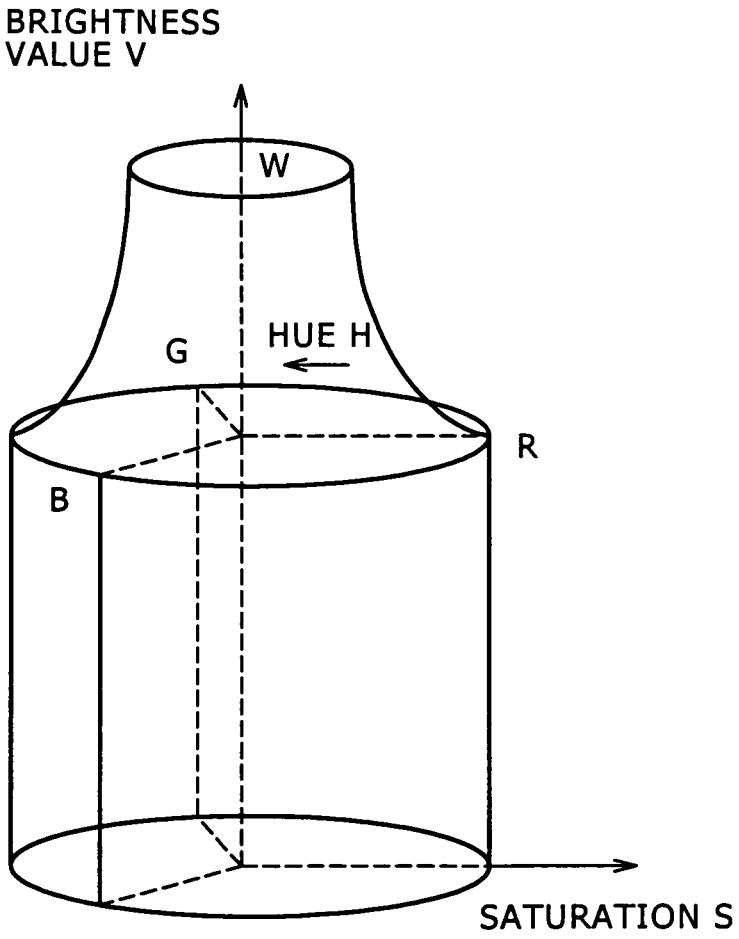
FIG. 7 illustrates an expanded color space for the RGBW-type display apparatus.

FIG. 6 illustrates a color space for the RGB-type display apparatus. FIG. 7 illustrates the color space for the RGBW-type display apparatus. As illustrated in FIG. 6, every color can be plotted on coordinates defined by Hue (H), Saturation (S), and Value of Brightness (V). The HSV color space is defined by these attributes, i.e., the hue, saturation, and brightness value. The hue refers to gradation of color, such as red, blue, or green, and is an attribute that expresses an image difference best of all. The saturation is an index for representing a color, and is an attribute that indicates the degree of brilliance of the color. The brightness value is an attribute that indicates the degree of brightness of the color. Higher brightness values represent brighter colors. Regarding the hue in the HSV color space, zero degrees represent R, followed counterclockwise by G and B in a circumferential direction. The saturation indicates the proportion of gray in each color and how much the color is blurred, with 0% indicating the maximum degree of blurredness and 100% indicating complete lack of blurredness. As to the brightness value, 100% indicates the maximum degree of brightness, and 0% indicates darkness.

On the other hand, as illustrated in FIG. 7, the attributes that define the color space for the RGBW-type display apparatus are basically the same as the attributes that define the color space for the RGB-type display apparatus, except that the brightness value is expanded by the addition of W. As described above, the difference in the color space between the RGB display apparatus and the RGBW display apparatus can be represented by the HSV color space as defined by the hue (H), the saturation (S), and the brightness value (V). It is apparent that the dynamic range of the brightness value (V) as expanded by the addition of W, as described above with reference to FIG. 5, varies greatly in accordance with the saturation (S).

Accordingly, in the signal processing method and the display apparatus according to the present embodiment, in view of the fact that the coefficient α used in the extension process for the Ri, Gi, and Bi signals, which are the input image signals, varies in accordance with the saturation (S), the Ri, Gi, and Bi signals, which are the input image signals, are analyzed to determine the extension coefficient α for each picture, so that the pictures can be displayed by the RGBW display apparatus so as to maintain the image quality of the input pictures.

At this time, it is desirable that the extension coefficient α be determined for each value of the saturation (S), from zero to the maximum value (255 in the case of 8 bits), via the analysis of the input image signals. Further, the minimum of the obtained extension coefficients α is adopted to allow the extension process to be performed without debasing the image quality at all. Also, in the signal processing method and the display apparatus according to the present embodiment, the extension process is performed based on a ratio between the value of max(R, G, B) of the input image and the maximum brightness value V in the HSV color space. In particular, this ratio is calculated with respect to each value of the saturation (S), from zero to the maximum value, and the minimum of the obtained ratios is used as the extension coefficient to perform the extension process.

Notice here that, in order to maintain the image quality as well as possible, it is desirable that all pieces of pixel data in the input image signals be analyzed. On the other hand, in order to increase processing speed and reduce circuit scale of processing blocks, it is desirable that n (n is a natural number) input image signals be skipped cyclically while the remaining input image signals are analyzed. Further, it is also desirable that at least one of the RGB data of the input image signal be analyzed. Still further, it is needless to say that a human engineering approach may be adopted as a method of determining the extension coefficient α.

Also notice that a slight local change in the Ri, Gi, and Bi signals, which are the input image signals, is not perceivable to humans. As such, a greater degree of the extension can be achieved while preventing the perception of the change in the image quality, by setting the extension coefficient α at the maximum possible value that does not permit the perception of the change in the image quality. In other words, the extension process is carried out such that the perception of the change in the image quality will be avoided.

Figure 8:
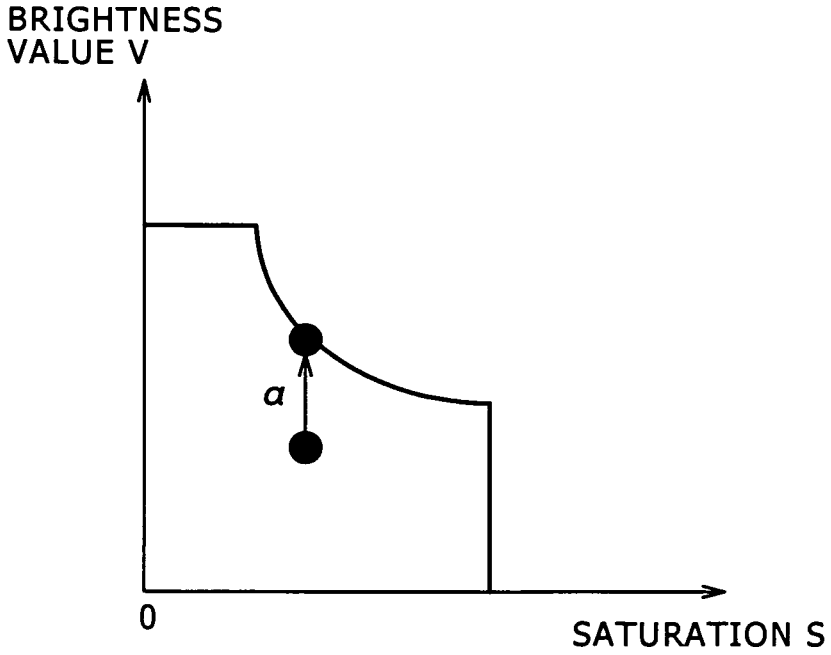
FIG. 8 is a cross-sectional view of the expanded color space for the RGBW-type display apparatus.

As illustrated in FIG. 8, the extended image signal is generated based on the extension coefficient α as determined by comparing the levels of the input image signals against the expanded RGBW color space.

By extending the input image signals in the above-described manner, it is possible to increase the value of Wo, which contributes to an additional improvement in the brightness of the entire image, which may in turn lead to a significant reduction in the power consumption of the backlight. Also, the image can be displayed with the same brightness as that of the input image signal, with the brightness of the backlight reduced by 1/α based on the extension coefficient α.

Next, a method of determining Wo based on the extended image signals Ri', Bi', Gi' will now be described below.

In the present embodiment, an X signal component is extracted from the extended RGB image signals, and the input image is analyzed when determining an X signal level to determine the X signal level. The maximum possible value of an X signal is determined to be the X signal level. A more detailed description will be provided below.

As described above, it is desirable that the extended image signals Ri', Gi', and Bi' be analyzed to obtain the minimum value of each pixel, i.e., Min(Ri', Gi', Bi'), and that the value of Wo be determined to be Wo=Min(Ri', Gi', Bi'). This value is the maximum possible value of Wo, and produces the best possible effect of reduced power consumption.

In other words, the best possible effect of reduced power consumption can be achieved when the value of Wo is determined by analyzing the extended image signals Ri', Gi', and Bi' to obtain the minimum value thereof, Min(Ri', Gi', Bi'), and using it as the value of Wo.

As a result of the determination of the value of Wo in the above-described manner, new RGB image signals can be calculated as follows.

$$Ro=Ri'Wo$$

$$Go=Gi'Wo$$

$$Bo=Bi'Wo$$

By extending the input image signals in the above-described manner, it is possible to increase the value of Wo, which contributes to an additional improvement in the brightness of the entire image, which may in turn lead to a significant reduction in the power consumption of the backlight. Also, the image can be displayed with the same brightness as that of the input image signal, with the brightness of the backlight reduced by 1/α based on the extension coefficient α.

The above-described extended image signals are generated based on the extension coefficient α as determined by comparing the brightness levels of the input image signals against the RGBW color space. Therefore, the extension coefficient α is image analysis information that is obtained as a result of analysis of one frame image. This image analysis information is held in the image analysis information holding section 3*d* to be used for the conversion of the image signals of the next frame, so that the RGBW conversion is accomplished properly without storing the image signals in a frame memory. The modulation level is determined based on the maximum brightness value of each pixel in the RGB signals.

Since the value of α is determined by comparing the brightness levels of the input image signals against the color space, a slight change in the image information does not affect the value of α. For example, even if there is an image moving across a screen, the value of α remains the same as long as the brightness or chromaticity does not change significantly. Therefore, even if the RGBW conversion is performed using the value of α determined with reference to the previous frame, no problem arises. Note that examples of the modulation process include the process of performing the extension process on the RGB signals to increase the brightness values, and the process of reducing the brightness of the light source.

As described in detail above, the above-described embodiment of the present invention allows the image conversion process to be achieved without the use of a frame memory, and makes it possible to provide a high performance and low power consumption display apparatus and so on while achieving a reduction in the size and cost of the IC.

One embodiment of the present invention has been described above. Note, however, that the present invention is not limited to the above-described embodiment. It should be understood by those skilled in the art that various modifications, combinations, sub-combinations and alterations may occur depending on design requirements and other factors insofar as they are within the scope of the appended claims or the equivalents thereof.

For example, in the description of the above-described embodiment, the RGBW signal processing has been described with reference to the liquid crystal display equipped with the backlight. Note, however, that the present invention is also applicable to other types of video display apparatuses, such as an organic electro-luminescence (EL) display, a plasma display panel (PDP), a surface-conduction electron-emitter display (SED), and a cathode ray tube (CRT).

Also note that each pixel may be made up of subpixels in which RGB color filters are arranged and a W subpixel formed by a luminescent layer, and that all the RGBW subpixels may be formed by a luminescent layer. Also note that the present invention is also applicable to a reflective display equipped with a frontlight unit, and therefore is also suitable for use in a display apparatus designed for electronic paper, where low power consumption is desired.

In the above-described embodiment, the RGBW subpixels are adopted. Note, however, that subpixels other than the W subpixels, such as yellow, cyan, or magenta subpixels, may be adopted in other embodiments of the present invention.

Also note that the present invention is also applicable to display apparatuses such as a multi-panel projector. In this case also, an improvement in the brightness and a reduction in the power consumption can be achieved.

The present application contains subject matter related to that disclosed in Japanese Priority Patent Application JP 2008-183033 filed in the Japan Patent Office on Jul. 14, 2008, the entire content of which is hereby incorporated by reference.

What is claimed is:

1. A display apparatus comprising:

a signal processing section configured to receive input image signals and display the input image signals in different frames;

a gamma processing section configured to transform input image signals into a current displayed frame of the input image signals and a subsequent displayed frame of the input image signals, said input image signals including signals of primary colors;

an image analysis section configured to extract an extension coefficient from said current displayed frame of the input image signals, said extension coefficient being used to convert said subsequent displayed frame of the input image signals into extended signals of the primary colors, wherein said extended signals of the primary colors are used to calculate a signal of a different color, said extended signals of the primary colors and said signal of the different color being used to calculate other signals of the primary colors, wherein said subsequent displayed frame of the input image signals occurs after said current displayed frame of the input image signals.

2. The display apparatus according to claim 1, wherein said primary colors are from the group consisting of red, green and blue.

3. The display apparatus according to claim 1, wherein said primary colors are from the group consisting of yellow, cyan, and magenta.

4. The display apparatus according to claim 1, wherein said different color is white.

5. The display apparatus according to claim 1, wherein a gradation-brightness characteristic for said current displayed frame of the processed signal has a linear relationship.

6. The display apparatus according to claim 1, wherein a gradation-brightness characteristic for said subsequent displayed frame of the processed signal has a linear relationship.

7. The display apparatus according to claim 1, further comprising:

an inverse gamma processing section configured to transform a converted signal into a color image signal, said converted signal being said signal of the different color along with said other signals of the primary colors, wherein said color image signal is used to drive subpixels of a display pixel section.

8. The display apparatus according to claim 7, wherein said inverse gamma processing section is configured to perform an inverse gamma computation process, said inverse gamma computation process being performed to convert said extended signals into said color image signal.

9. The display apparatus according to claim 7, wherein said current displayed frame of the input image signals is displayable on said display pixel section before said subsequent displayed frame of the input image signals.

10. The display apparatus according to claim 7, wherein a brightness level of the input image signals differs from a brightness level of the color image signal.

11. The display apparatus according to claim 1, wherein said gamma processing section is configured to perform a gamma computation process, said gamma computation process being performed to transform said input image signals into said current displayed frame of the input image signals.

12. The display apparatus according to claim 11, wherein said gamma computation process is performed to transform said input image signals into said subsequent displayed frame of the input image signals.

13. The display apparatus according to claim 11, wherein said extension coefficient is a natural number.

* * * * *